US005587733A

United States Patent [19]

Ono et al.

[11] Patent Number: 5,587,733

[45] Date of Patent: Dec. 24, 1996

[54] RECORDING APPARATUS WHICH AVOIDS INK SHEET STICKING AND IMAGE STREAKING

[75] Inventors: Takeshi Ono, Yokohama; Takehiro Yoshida, Tokyo; Makoto Kobayashi, Tama; Satoshi Wada, Kawasaki; Hisao Terajima, Yokohama; Minoru Yokoyama, Yokohama; Takashi Awai, Yokohama; Akihiro Tomoda, Yokohama; Yasushi Ishida, Tokyo, all of Japan

[73] Assignee: Canon Kabushiki Kaisha, Tokyo, Japan

[21] Appl. No.: 329,621

[22] Filed: Oct. 26, 1994

Related U.S. Application Data

[63] Continuation of Ser. No. 89,639, Jul. 9, 1993, abandoned, which is a continuation of Ser. No. 431,840, Nov. 6, 1989, abandoned.

[30] Foreign Application Priority Data

Nov. 9, 1988 [JP] Japan ..... 63-281372

[51] Int. Cl.[6] ..... B41J 2/38

[52] U.S. Cl. ..... 347/185

[58] Field of Search ..... 346/76 PH; 347/185, 347/186, 187

[56] References Cited

U.S. PATENT DOCUMENTS

| | | | |
|---|---|---|---|
| 4,449,136 | 5/1984 | Moriguchi et al. | 347/186 |
| 4,531,133 | 7/1985 | Leng | 346/76 PH |
| 4,568,817 | 2/1986 | Leng et al. | 347/186 |
| 4,617,580 | 10/1986 | Miyakawa | 346/136 |
| 4,675,698 | 6/1987 | Tsutsumi | 346/76 PH |
| 4,760,462 | 7/1988 | Ogawa | 346/76 PH |
| 4,814,789 | 3/1989 | Ono | 346/76 PH |
| 4,837,813 | 6/1989 | Terajima | 379/113 |
| 4,963,884 | 10/1990 | Kiguchi et al. | 346/76 PH |

FOREIGN PATENT DOCUMENTS

| | | | |
|---|---|---|---|
| 116175 | 7/1983 | Japan | 347/186 |
| 0201686 | 11/1983 | Japan . | |
| 0095177 | 6/1984 | Japan . | |
| 0094360 | 4/1987 | Japan | 346/76 PH |
| 62-173267 | 7/1987 | Japan . | |
| 62-39969 | 9/1987 | Japan | 346/76 PH |
| WO88/00530 | 1/1988 | WIPO . | |

OTHER PUBLICATIONS

Eur. Pat. Off. Search Report for Eur. Pat. App. 89120816.7.

*Primary Examiner*—N. Le

*Attorney, Agent, or Firm*—Fitzpatrick, Cella, Harper & Scinto

[57] ABSTRACT

A heat transfer recording apparatus for recording an image on a recording medium by transferring an ink possessed by an ink sheet to the transfer medium comprises conveying means for conveying the ink sheet and the recording medium, recording means for recording an image on the recording medium, and control means for controlling the recording means after an image has been recorded by the recording means so as to record the image over again by using the same data after the ink sheet has been conveyed while the recording medium being stopped.

50 Claims, 11 Drawing Sheets

RECORDING APPARATUS WHICH AVOIDS INK SHEET STICKING AND IMAGE STREAKING

This application is a continuation of application Ser. No. 08/089,639 filed Jul. 9, 1993, which is a continuation of application Ser. No. 07/431,840 filed Nov. 6, 1989, both abandoned.

BACKGROUND OF THE INVENTION

1. Field of the Invention

The present invention relates to a heat transfer recorder and facsimile apparatus which is capable of recording an image on a recording medium by transferring the ink on an ink sheet to the recording medium.

Examples of heat transfer recorders include facsimile apparatus, as well as other apparatuses having the function of recording such as electronic typewriters, copying apparatuses and printers.

2. Related Background Art

Heat transfer printers generally record an image by selectively heating the ink sheet used, which has a base film on which a hot-melt (or heat-subliming) ink is coated, using a thermal head in correspondence with the image signal and by transferring the melted (or sublimed) ink to recording paper. Of such heat transfer printers, in particular, heat transfer printers which employ a full-line type of thermal head record an image by driving the thermal head which is divided into blocks for the purpose of reducing the power required for driving the thermal head and the like. Further, when an image is recorded by a command to print one line, moving writing is generally employed for recording in which the time for driving the motor used for conveying recording paper is the same as the recording time for one line. However, if the recording is started from a state wherein the recording paper is completely stopped, the movement of the recording paper is slower than the movement actual recording of an image. Accordingly, a blank portion (white line) may occur in the recorded image.

FIG. 7 is a timing chart which shows the multi-scanning operation for preventing the occurrence of such a white line. In the drawing, reference numeral 70 denotes a curve which shows the distance for which recording paper is actually moved by the drive using a motor denoted by reference numeral 72. Reference numeral 71 denotes a straight line which shows the ideal moving distance of the recording paper. A thermal head is divided into four blocks. Reference numerals STB1 to STB4 respectively denote the timing charts of energization of the blocks. As seen from the drawing, in the main printing timing denoted by 72, the recording paper is not completely moved for one line and is moved Δl after the record of one line has been completed. This delay causes a problem which is common to known recording devices, where when the record of the next line is performed without any other operations, therefore, a blank portion corresponding to Δl is produced between the present line and the next line. Reference numeral S1 denotes a given moving amount of the recording paper for one line.

In order to prevent the occurrence of such a blank portion, as shown by reference numeral 73, the thermal head is energized again by using the same data while the recording paper is stopped at the same position a given time after the record of one line has been completed (referred to as "auxiliary recording" hereinafter). During this auxiliary recording, the energezation time of each of the blocks of the thermal head is shorter than that of normal image recording. As a result, the record of the image is performed in the portion denoted by Δl so that the white line can be prevented from occurring. However, such auxiliary recording is generally a technique used for recording on heat-sensitive paper, and heat-transfer printers which perform recording on recording paper by employing heat transfer particularly involve a problem with respect to the movement of the ink sheet.

SUMMARY OF THE INVENTION

It is an object of the present invention to provide a heat-transfer recorder and facsimile apparatus which are capable of improving the quality of the image recorded.

It is another object of the present invention to provide a heat-transfer recorder and facsimile apparatus which are capable of reducing the consumption of the ink sheet.

It is still another object of the present invention to provide a heat-transfer recorder and facsimile apparatus which are capable of preventing the occurrence of a white line on the recording medium by recording again image data while moving an ink sheet in a state wherein the recording medium is stopped after recording has been completed.

BRIEF DESCRIPTION OF THE DRAWINGS

FIGS. 5A1–5A2 are flow charts which shows recording process in an embodiment;

DETAILED DESCRIPTION OF THE PREFERRED EMBODIMENT

In the heat-transfer recorder described below in an embodiment to which the present invention is applied, after an image has been recorded on a recording medium by the action on an ink sheet, the same data is recorded again on the recording paper while the ink sheet is moved without the recording paper being moved.

In facsimile apparatus of an embodiment to which the present invention is applied, an image is recorded on recording medium by the action on an ink sheet on the basis of the image information from an image input means or a transmit-receive means. After the image has been recorded, the same data is recorded again on the recording paper while the ink sheet is moved without the recording paper being moved until the next image information is formed.

A preferred embodiment of the present invention will be described in detail below with reference to the attached drawings.

Description of Facsimile Apparatus (FIGS. 1 to 4)

Figure 1:
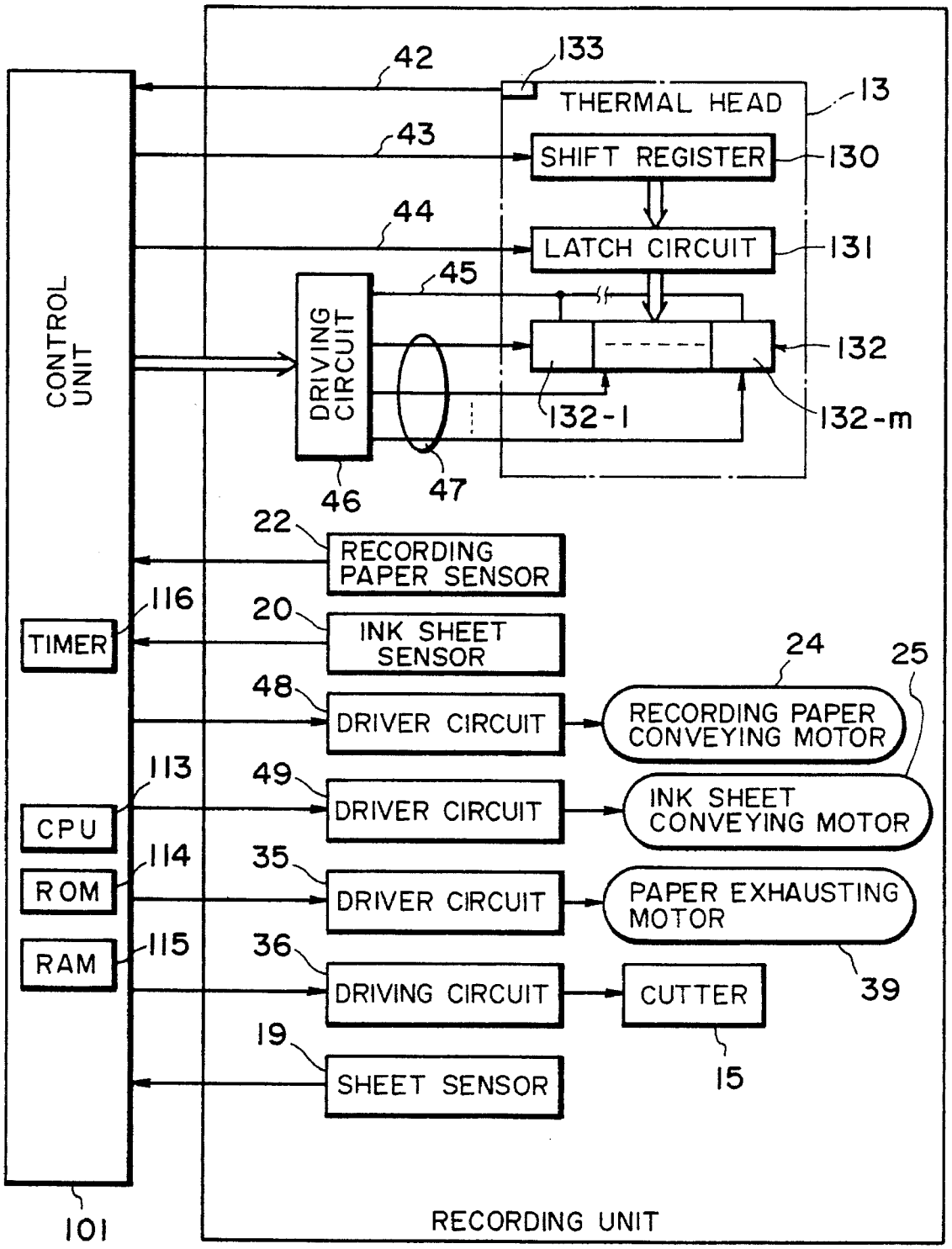
FIG. 1 is a drawing which shows the electrical connection between a control unit and a recording unit in an embodiment to which the present invention is applied.
Figure 4:
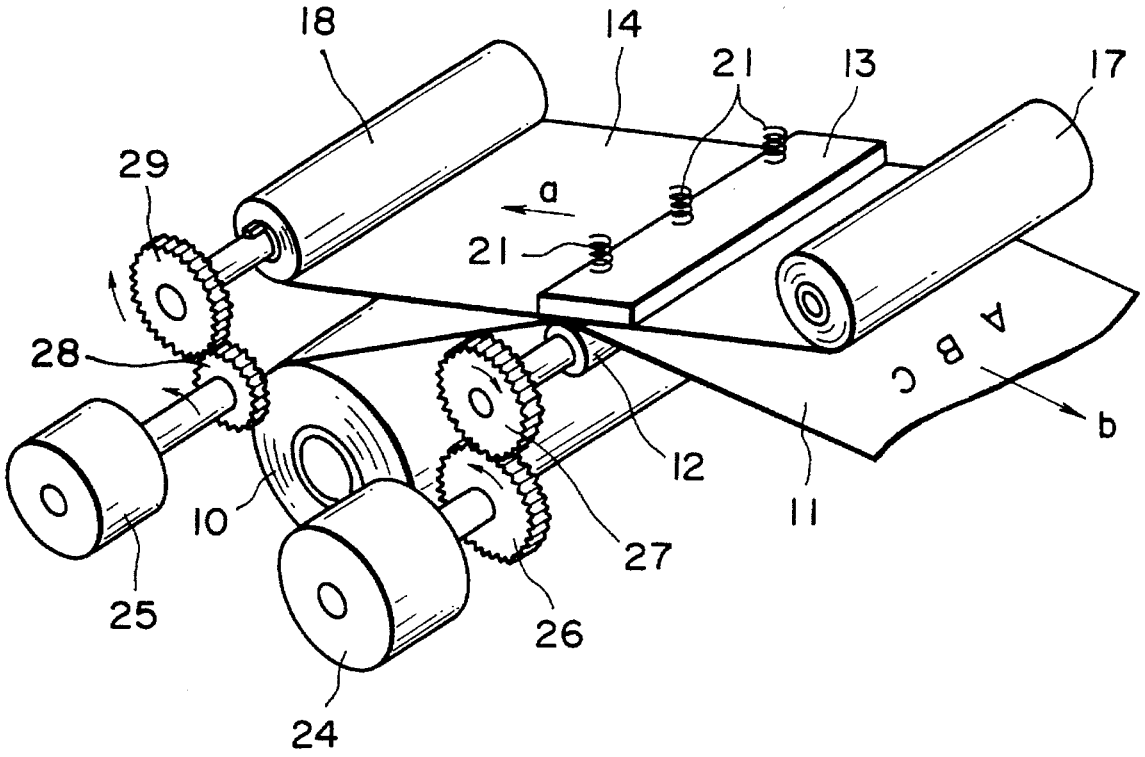
FIG. 4 is a drawing of the structure of a conveyance system for an ink sheet and recording paper.

FIGS. 1 to 4 are drawings of an example in which a heat-transfer printer employing an embodiment of the present invention is applied to facsimile apparatus. FIG. 1 is a drawing which shows the electrical connection between a control unit 101 and a recording unit 102 of the facsimile apparatus; FIG. 3A is a sectional side view of the facsimile apparatus; FIG. 3B is a perspective view of the outline of the facsimile apparatus; and FIG. 4 is a drawing of the mechanism of conveyance of recording,paper and an ink sheet.

Figure 2:
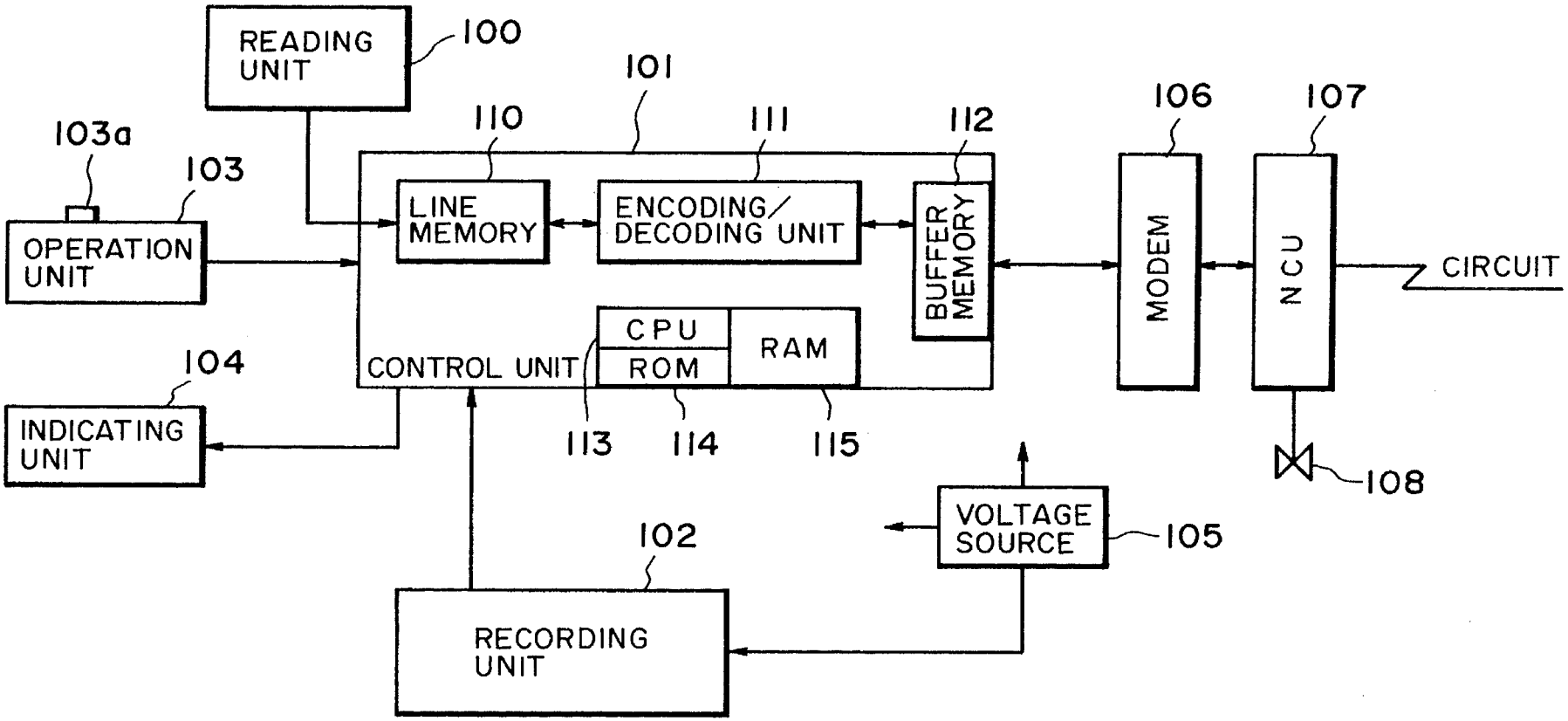
FIG. 2 is a schematic block diagram of the configuration of facsimile apparatus of an embodiment.
Figure 3A:
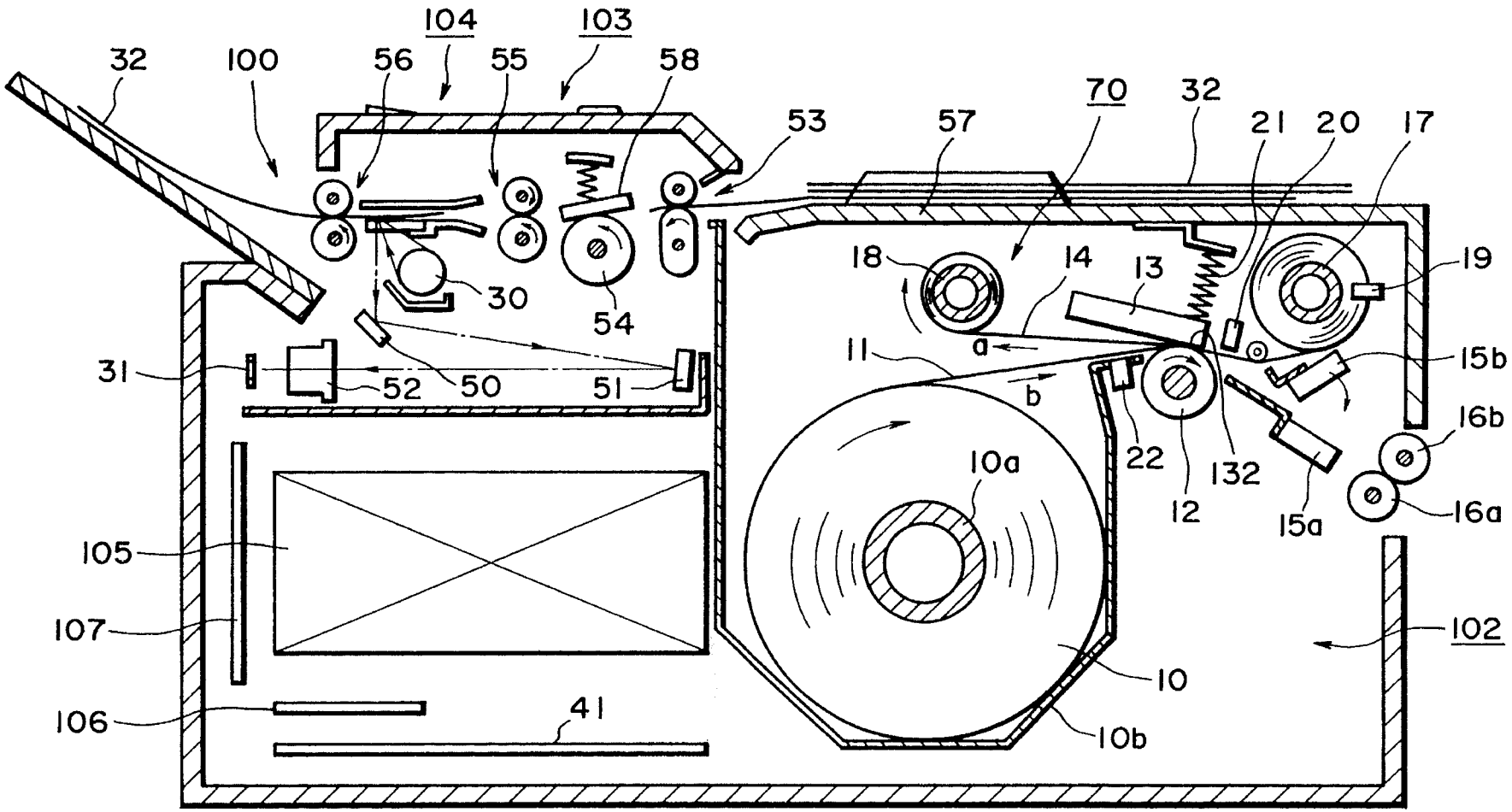
FIG. 3A is a sectional side view of a mechanism unit for the facsimile apparatus of an embodiment.
Figure 3B:
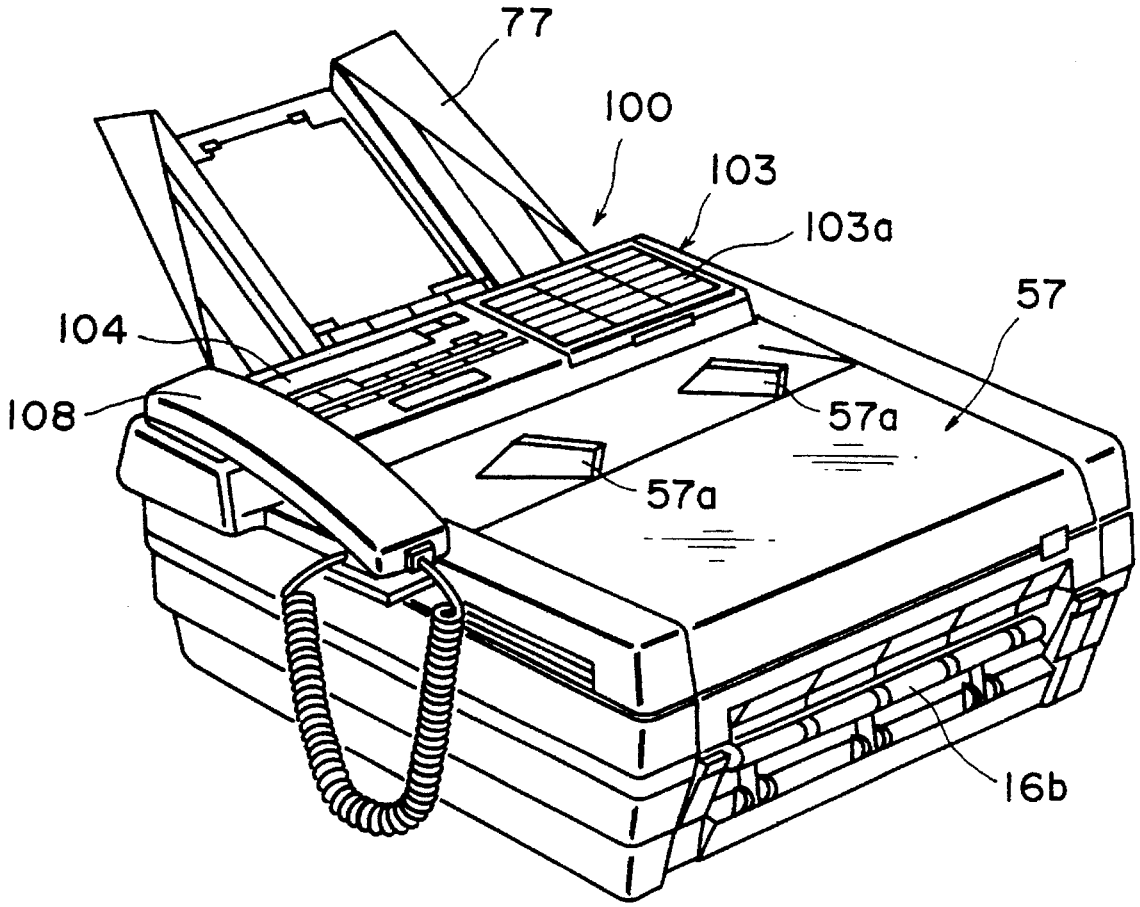
FIG. 3B is a perspective view of the outline of the same facsimile apparatus.

The configuration of the facsimile apparatus is first schematically described below with reference to FIG. 2.

In the drawing, reference numeral 100 denotes a reading unit for photoelectrically reading an original and outputting as a digital image signal to the control unit 101, the reading unit being provided with an original conveying motor, a CCD image sensor and others. The configuration of the control unit 101 is described below. Reference numeral 110 denotes a line memory for storing image data of each line. The image data for one line from the reading unit 100 is stored in the memory 110 during the transmission or copying of an original, and the one-line data of the received image data decoded is stored in the memory 110 during the reception of the image data. When the stored data is output to the recording unit 102, an image is formed. Reference numeral 111 denotes an encoding/decoding unit for encoding image information to be transmitted by an MH coding method and converting the encoded image data received into image data by decoding it. Reference numeral 112 denotes a buffer memory for storing the coded image data to be transmitted or received. Each of the units of the control unit 101 is controlled by CPU 113 such as a microprocessor or the like. The control unit 101 is provided with the CPU 113, as well as ROM 114 for storing a control program and various items of data and RAM 115 serving as a work area for temporarily storing various items of data.

The recording unit 102 is provided with a thermal line head for recording an image on recording paper by a heat transfer recording method. This configuration is described in detail below with reference to FIG. 3. Reference numeral 103 denotes an operation unit containing keys for indicating various functions such as the start of transmission and keys for inputting telephone numbers, and reference numeral 103*a* denotes a switch for indicating the type of the ink sheet 14 used. When the switch 103*a* is turned on, a multi-printing ink sheet is mounted and when the switch 103*a* is turned off, a normal ink sheet is mounted. Reference numeral 104 denotes an indicating unit which is generally provided near the operation unit 103 for the purpose of indicating various functions and states of the apparatus. Reference numeral 105 denotes a power source for supplying electric power to the whole of the apparatus. Reference numeral 106 denotes a modem; (modulation and demodulation unit); reference numeral 107, a net control unit (NCU); and reference numeral 108, a telephone.

The configuration of the recording unit 102 is described in detail below with reference to FIG. 3. The same portions as those in FIG. 2 are denoted by the same reference numerals.

In the drawings, reference numeral 10 denotes roll paper which is normal recording paper 11 wound around a core 10*a* into a roll. The roll paper 10 is rotatably received in the apparatus so that the recording paper 11 can be supplied to a thermal head portion 13 by the rotation of a platen roller 12 in the direction shown by an arrow. Reference numeral 10*b* denotes a roll paper loading portion on which the roll paper 10 is detachably loaded. The platen roller 12 is designed so as to convey the recording paper 11 in the direction shown by an arrow b, as well as pressing the ink sheet 14 and the recording paper 11 between the heating element 132 of the thermal head 13 and the platen roller 12. The recording paper 11 on which an image is recorded by the generation of heat from the thermal head 13 is conveyed toward exhausting rollers 16 (16*a*, 16*b*) by further rotations of the platen roller 12 and cut in the paper unit by the engagement between cutters 15 (15*a*, 15*b*) and exhausted when the recording of an image is completed for one page.

Reference numeral 17 denotes an ink sheet supply roll on which the ink sheet 14 is wound; and reference numeral 18 denotes an ink sheet take-up roll which is driven by the ink sheet conveying motor described below for taking up the ink sheet 14 in the direction shown by an arrow a. The ink sheet supply roll 17 and the ink sheet take-up roll 18 are detachably loaded on an ink sheet loading portion 70 in the apparatus body. Reference numeral 19 denotes a sensor for detecting the amount of the remaining ink sheet 14 and the conveyance speed of the ink sheet 14. Reference numeral 20 denotes an ink sheet sensor for detecting the presence of the ink sheet 14; reference numeral 21, a spring for pressing the thermal head 13 against the platen roller 12 through the recording paper 11 and the ink sheet 14; and reference numeral 22, a recording paper sensor for detecting the presence of the recording paper.

The configuration of the reading unit 100 is described below.

In the drawings, reference numeral 30 denotes light source for applying light to an original 32, the light reflected from the original 32 passing through an optical system (mirrors 50, 51 and a lense 52) and being input to a CCD sensor 31 so as to be converted into an electrical signal. The original 32 is conveyed by conveyance rollers 53, 54, 55 and 56 which are driven by an original conveying motor (not shown) in correspondence with the speed employed for reading from the original 32. Reference numeral 57 denotes an original loading base, a plurality of originals 32 loaded on the loading base 57 being separated from each other by cooperation of the conveyance roller 54 and,a press separator 58 while being guided by sliders 57*a*. The originals 32 separated are then conveyed to the reading unit 100 and discharged onto a tray 77 after reading.

Reference numeral 41 denotes a control base plate which forms a principal portion of the control unit 101 and from which various control signals are output to each of the units of the apparatus. Reference numeral 105 denotes a power source unit; reference numeral 106, a base plate unit; and reference numeral 107, an NCU base plate unit.

Further, FIG. 4 is a detailed drawing of the mechanism of conveyance of the ink sheet 14 and the recording paper 11.

In the drawing, reference numeral 24 denotes a recording paper conveying motor for driving the platen roller 12 so as to convey the recording paper 11 in the direction shown by the arrow b which is opposite to the direction of the arrow a. Reference numeral 25 denotes an ink sheet conveying motor for conveying the ink sheet 14 in the direction shown by the arrow a. Reference numerals 26, 27 denote transmission gears for transmitting the rotation of the recording paper conveying motor 24 to the platen roller 12, and reference numerals 28, 29 denote transmission gears for transmitting the rotation of the ink sheet conveying motor 25 to the take-up roll 18.

In this way, the, conveyance direction of the recording paper 11 is reversed to the conveyance direction of the ink sheet 14 so that the direction in which images are successively recorded on the recording paper 11 in the lengthwise direction thereof (the direction of the arrow a, i.e., the direction opposite to the direction of conveyance of the recording paper 11) is the same as the direction of conveyance of the ink sheet 14. When a multi-ink sheet which allows several times (n) of recording at the same position is used as the ink sheet 14, assuming that the conveyance speed of the recording paper is $V_p$ and the conveyance speed of the ink sheet is $V_I$, $V_p=-nV_I$ (n>1). The negative sign—indicates that the directions of conveyance of the recording paper 11 and the ink sheet 14 are opposite to each other.

FIG. 1 is a drawing which shows the electrical connection between the control unit 101 and the recording unit 102 in the facsimile apparatus of the embodiment, in which the same portions as those shown in the other drawings are denoted by the same reference numerals.

The thermal head 13 is a line head and is provided with a shift register 130 for inputting serial record data for one line and a shift clock 43 which are sent from the control unit 101, a latch circuit for latching the data of the shift register 130 by using a latch signal, and the heating element 132 composed of a plurality of heating resistors for one line. The heating resistors 132 are divided into m block denoted by 132-l to 132-m. Reference numeral 133 denotes a temperature sensor which is provided on the thermal head 13 for detecting the temperature of the thermal head 13. The signal 42 output from the temperature sensor 133 is subjected to A/D conversion in the control unit 101 and then input to the CPU 113. This input signal causes the CPU 113 to detect the temperature of the thermal head 13 and the pulse width of a strobe signal 47 to be changed or the voltage for driving the thermal head 13 to be changed corresponding to the temperature so that the energy applied to the thermal head 13 is changed in correspondence with the characteristics of the ink sheet 14 used. Reference numeral 116 denotes a programmable timer in which a timer time is set from the CPU so that the timer is started when the start of the timer is indicated. An interrupt signal and a time out signal are output to the CPU 113 at each of the indicated times.

The type (characteristics) of the ink sheet 14 is indicated by the above-described switch 103 of the operation unit 103. The type (characteristics) of the ink sheet 14 may be automatically decided by detecting a mark printed on the ink sheet 14 or by detecting a mark, a notch or a projection formed on a cartridge of the ink sheet 14.

Reference numeral 46 denotes a driving circuit in which a signal for driving the thermal head 13 is input from the control unit 101 for the purpose of outputting the strobe signal used for driving the thermal head 13 in the block unit. The driving circuit 46 is capable of changing the energy applied to the thermal head 13 by changing the voltage output to the power source line 45 for supplying electric current to the heating element 132 of the thermal head 13 on the basis the indication from the control unit 101. Reference numeral 36 denotes a driving circuit for driving the cutters 15 so as to engage with each other which include a motor for driving the cutters. Reference numeral 39 denotes a paper exhausting motor for rotating a paper exhausting roller 16. Reference numerals 35, 31 and 32 respectively denote drive circuits for rotating the corresponding paper exhausting motors 39, the recording paper conveying motor 24 and the ink sheet conveying motor 25. Although each of the paper exhausting motor 39, the recording paper conveying motor 24 and the ink sheet conveying motor 25 is a stepping motor in this embodiment, each of the motors is not limited to this. For example, a DC motor may be used.

Description of Recording Operation (FIGS. 1 to 6)

Figures 1, 5A:
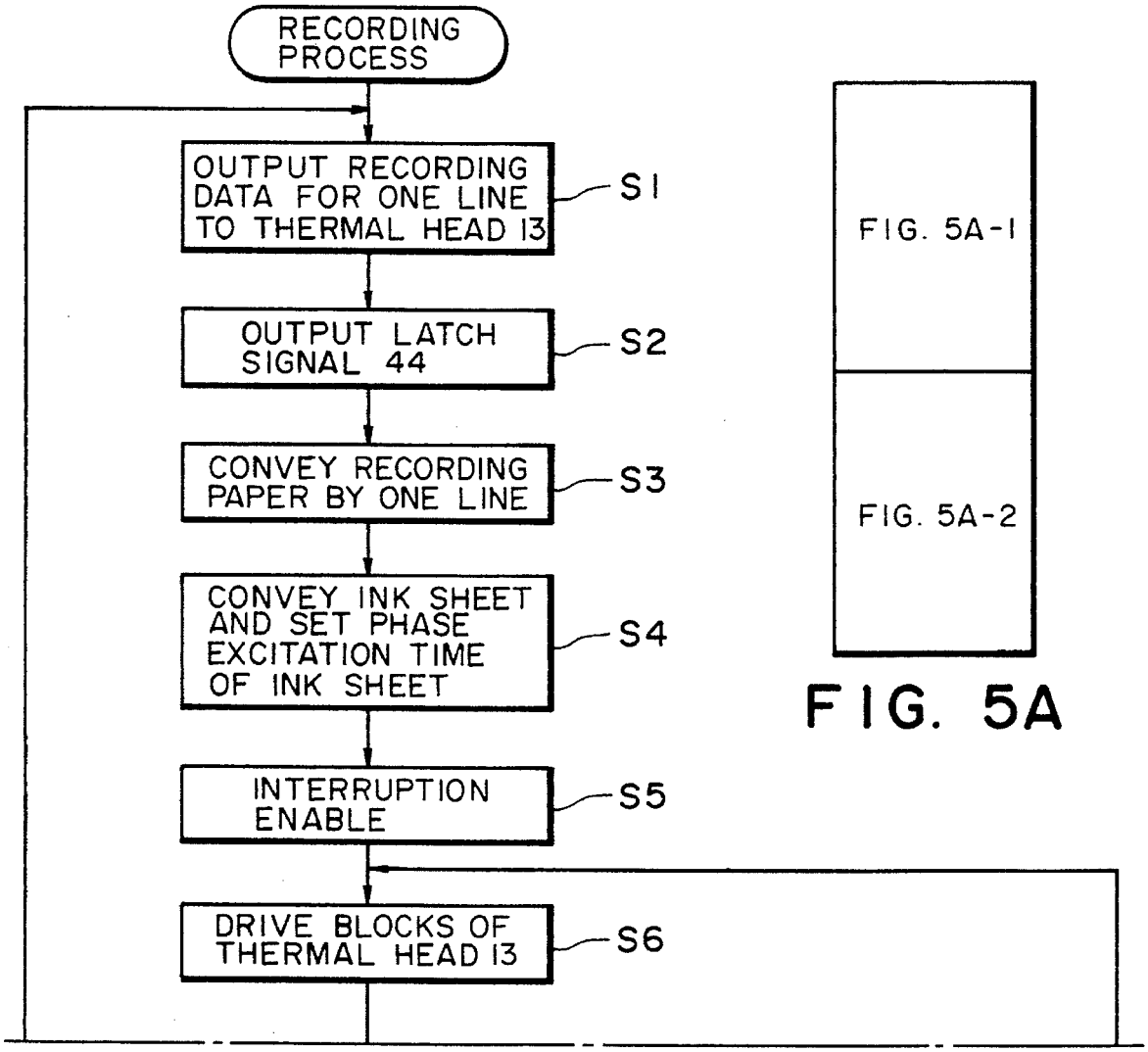
FIG. 5A comprising

FIG. 5A is a flow chart which shows a process of recording for one page in the facsimile apparatus of the embodiment. The control program for executing this processing is stored in the ROM 114 of the control unit 101.

This processing is started when the image data for one line to be recorded is stored in the line memory 110 and when a state wherein the recording operation can be started is established. In Step S1, the recording data for one line is first output to the shift register 130 in a serial manner. When the recording data for one line is completely transferred, in Step S2, the latch signal 44 is output so that the recording data for one line is stored in the latch circuit 131.

In Step S3, the recording paper is then conveyed for the length corresponding to one line. The length corresponding to one line is a length corresponding to one dot recorded by the thermal head 13. The processing then proceeds to Step S4 in which the ink sheet conveying motor 25 is driven for conveying the ink sheet 14 for the length corresponding to ¼ line. The time indicating the interval of phase excitation of the ink sheet conveying motor 25 for conveying the ink sheet 14 is set in the timer 116. In Step S5, interruption is then made enable by using the timer 116.

The recording paper conveying motor 24 requires one step for conveying the recording paper 11 for the length corresponding to one line, while the ink sheet conveying motor 25 is driven for 4 steps when the ink sheet 14 is conveyed for the length corresponding to one line. This can be realized by setting a ratio of 4:1 between the minimum step angles of the recording paper conveying motor 24 and the ink sheet conveying motor 25 or by respectively setting a gear ratio of 4:1 between the transmission gears 26 and 27 and between the transmission gears 28 and 29. Assuming that the moving time of the recording paper 11 when the recording paper 11 is conveyed for one line is $T_1$, the time required for recording one line is also $T_1$. In addition, since the ink sheet 14 is conveyed for one step at each time a time of $T_1/4$ has passed, the time of $T_1/4$ is set in the timer 116 in Step S4.

In Step S6, one of the blocks of the heating resistor 132 is then energized for recording the image, and in Step S7, a decision is made as to whether or not the energization of all the blocks of the thermal head is completed. In Step S7, if the energization of all the blocks of the thermal head 13 is not completed, and if the recording of one line is not completed, the processing proceeds to Step S8 in which a decision is made as to whether or not the energization time (about 600 usec) of one block of the thermal head has passed. If the energization time has passed, the processing returns to Step S6 in which the energization of the next block is driven.

In Step S8, if the energization time has not passed, the processing proceeds to Step S9 in which a decision is made as to whether or not interruptions input from the timer 116, for example, by deciding whether or not an interrupt flag is turned on. The interrupt flag is provided in the RAM 115 and set by an interrupt routine (not shown). If it is confirmed by the flag that the interruption is input from the timer 116, i.e., if the time of $T_1/4$ has passed, the flag is cleared, and the processing proceeds to Step S10 in which the ink sheet 14 is conveyed for a given length (¼ of one line) and returns to Step S8. The number of interruptions generated by the timer 116 is 3 during the recording of one line.

The recording timing during the recording of one line is described below with reference to FIG. 6.

Figure 6:
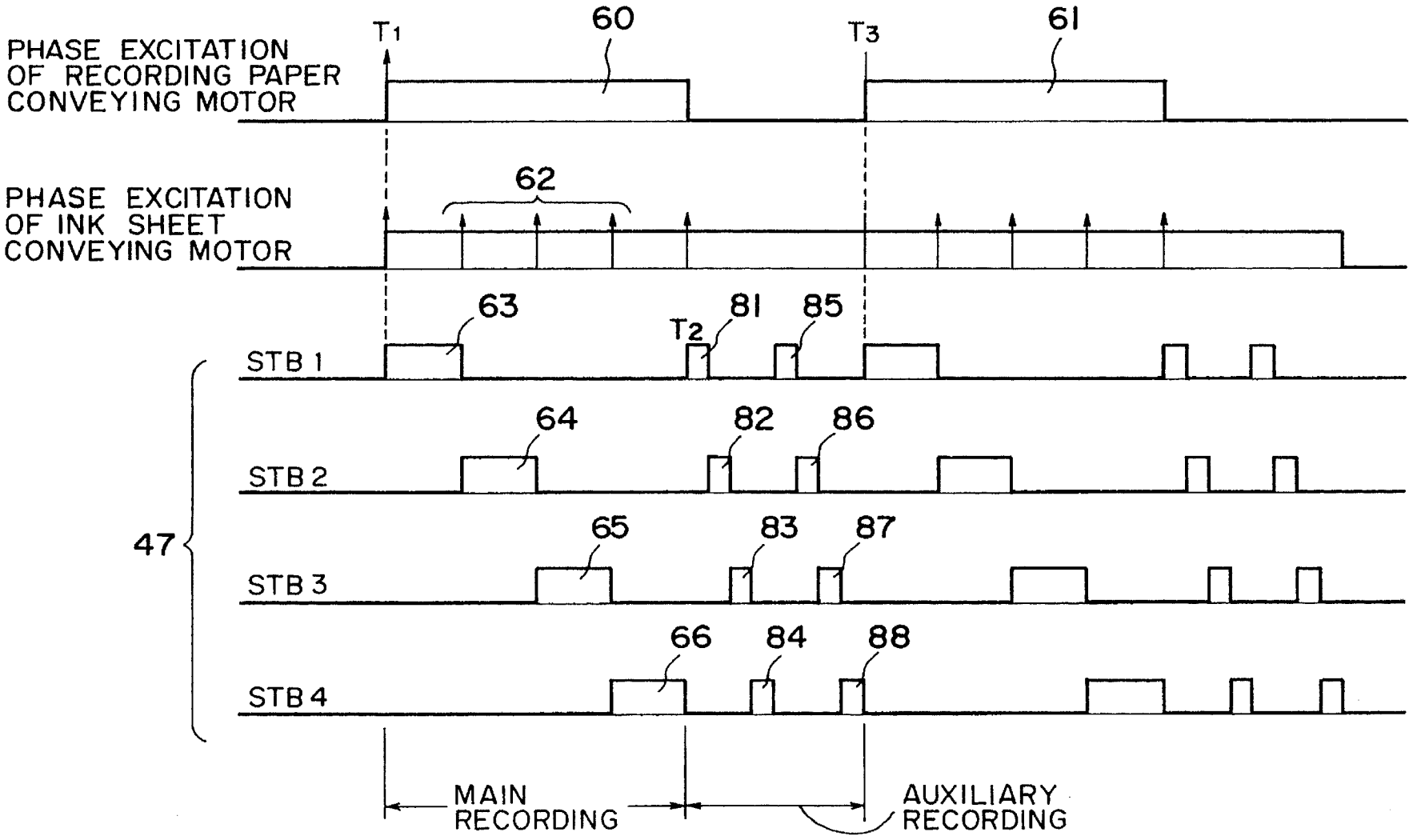
FIG. 6 is a drawing which shows the timing of the main recording and auxiliary recording in the embodiment shown in FIG. 5A.
Figure 7:
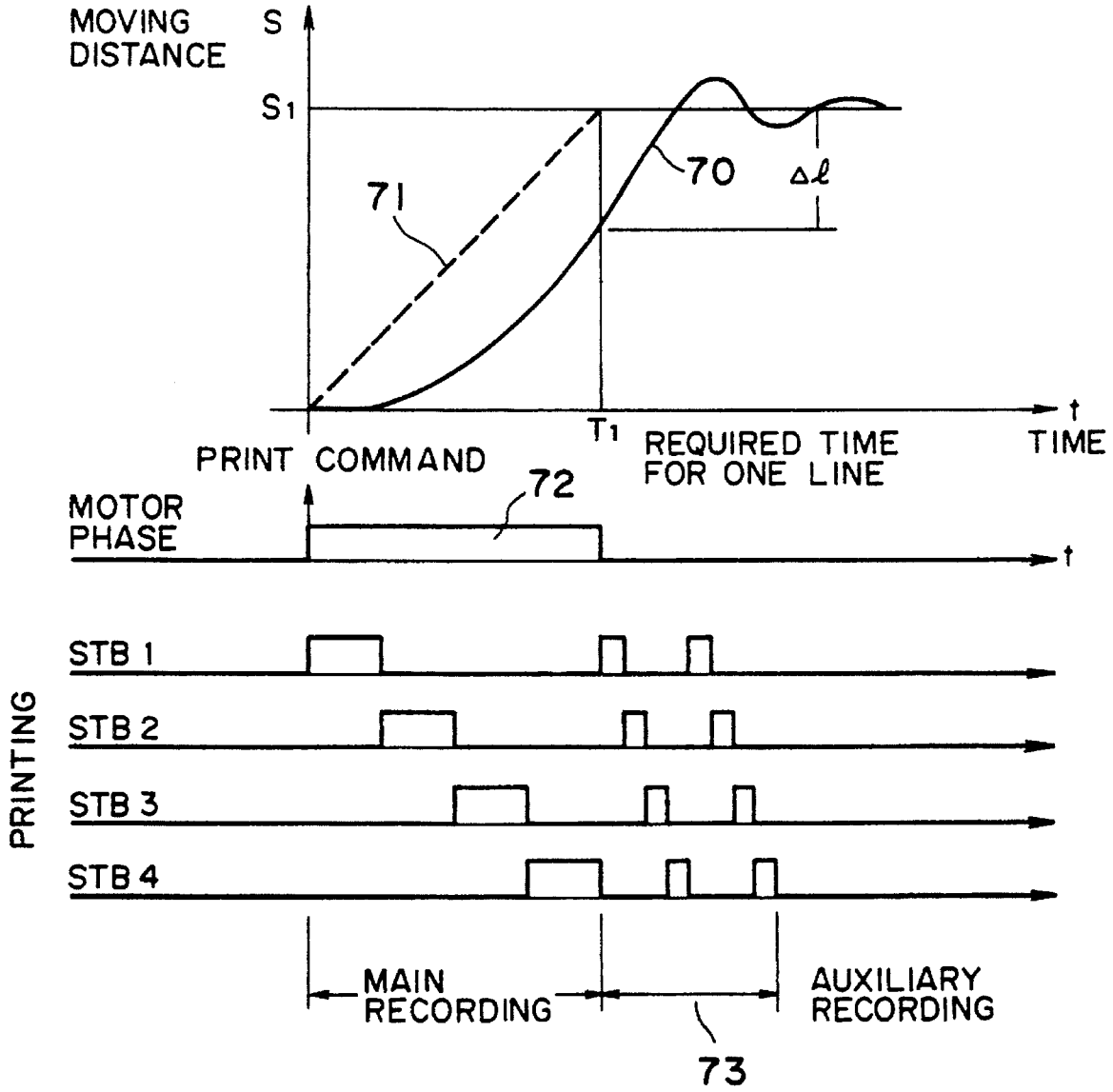
FIG. 7 PRIOR ART
FIG. 7 is a drawing which shows the moving distance of the recording paper and the timing of the main recording and auxiliary recording.

In FIG. 6, reference numeral 60 denotes the recording timing of the first line of an image, and reference numeral 61 denotes the recording timing of the second line of the image. The timing T1 indicates the timing of conveyance of the recording paper 11 and the ink sheet 14 in Steps S3 and S4. Since the heating resistor 132 of the thermal head 13 is divided into four blocks (m=4) so as to be driven, reference numerals 63 to 66 respectively denote the energization timing of the blocks during the recording of one line. Reference numeral 62 denotes the timing at which the ink sheet 14 is conveyed by the interruption generated by the timer 116 during the recording of one line in Step S10.

The processing again returns to Step S7 shown in the flow chart of FIG. 5A and, when the recording of one line is terminated, the processing proceeds to Step S11 in which a decision is made as to whether or not the recording of one page is completed. If the recording of one page is not completed, the processing proceeds to Step S12 in which a decision is made whether or not the image data to be recorded on the next line is prepared. When the image data of the next line is prepared, the processing returns to Step S1 in which the recording data of the next line is transferred to the thermal head and proceeds to the recording of the image of the next line.

On the other hand, when it is decided in Step S12 that the image data of the next line is not prepared, the processing proceeds to Step S13 in which the ink sheet 14 is conveyed for a given length (for example, ¼ line). In Step S14, the above-described auxiliary recording is then executed.

The operations in Steps S13 and S14 are described below with reference to FIG. 6. The conveyance of the ink sheet 14 in Step S13 is denoted by timing T2, and reference numerals 81 to 84 respectively denote the timing of the auxiliary recording of the four blocks of the thermal head 13. In this way, the energization time during the auxiliary recording of each of the blocks is set to a time shorter than that during actual recording.

In Step S15, a decision is then made as to whether or not the data of the next line is prepared. When the recording data of the next line is not prepared, the processing returns to Step S14 in which the next auxiliary recording (denoted by reference numerals 85 to 88 in FIG. 6) is executed. While, when it is decided in Step S15 that the recording data of the next line is prepared, after the auxiliary recording has been stopped in Step S16, the processing returns to Step S1 in which the recording of the image of the next line (denoted by reference numeral 61) is executed after the timing T3 shown in FIG. 6.

The number of times of auxiliary recording may be previously set to the maximum. In this case, when the number of times of auxiliary recording reaches the maximum, the processing returns to Step S1 even if the image data of the next line is not prepared.

Figures 2, 5A:
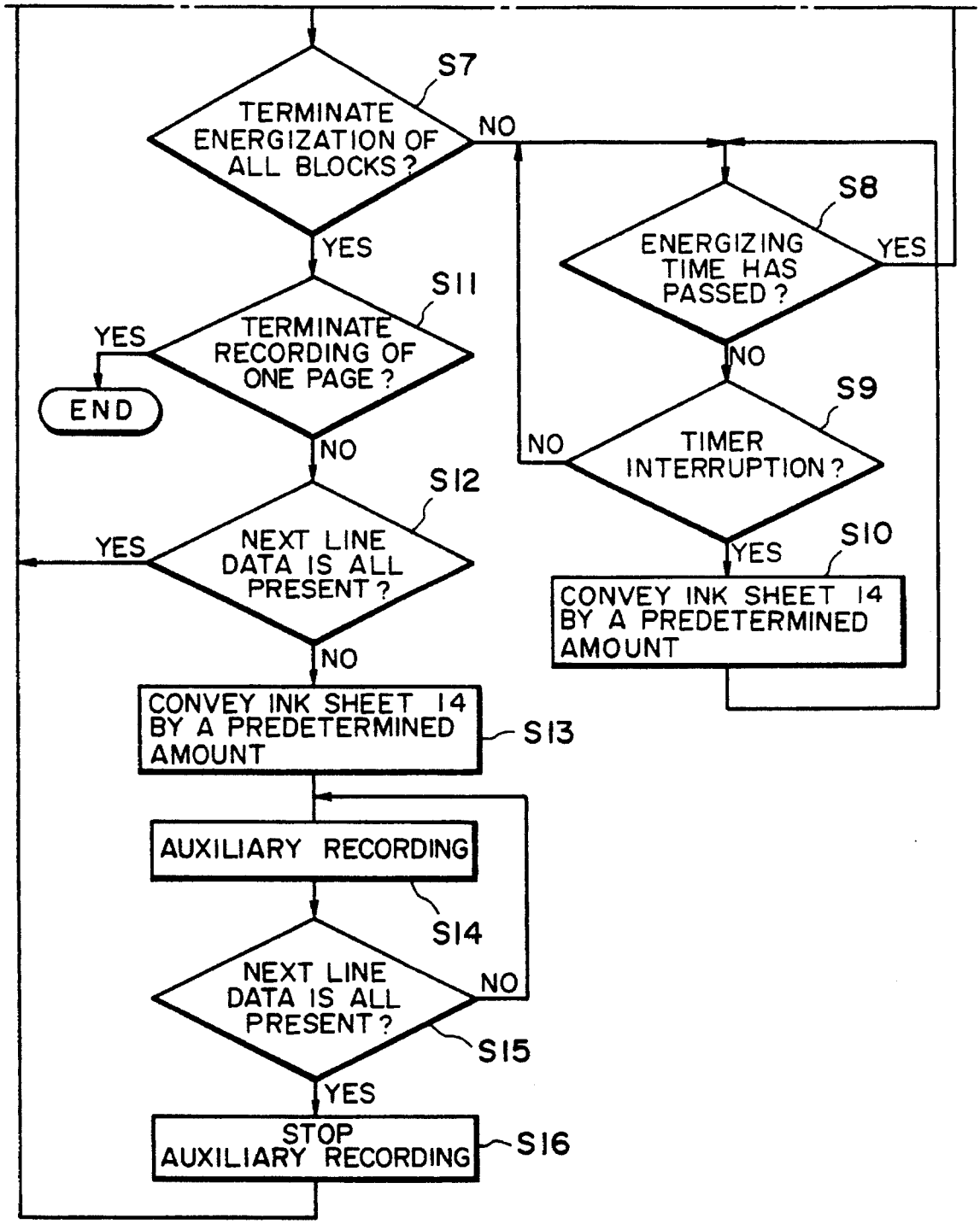

Although not shown in the flow chart in FIG. 5, when it is decided in Step S11 that the recording of one page is completed, the recording paper 11 is sent by a given length toward the paper exhausting rollers 16*a*, 16*b* and cut in the page unit by the engagement between the cutters 15*a* and 15*b*. The recording paper conveying motor 24 is then reversed so that the recording paper 11 is returned by a distance corresponding to the distance between the thermal head 13 and the cutters 15 and is then cut.

Figure 5B:
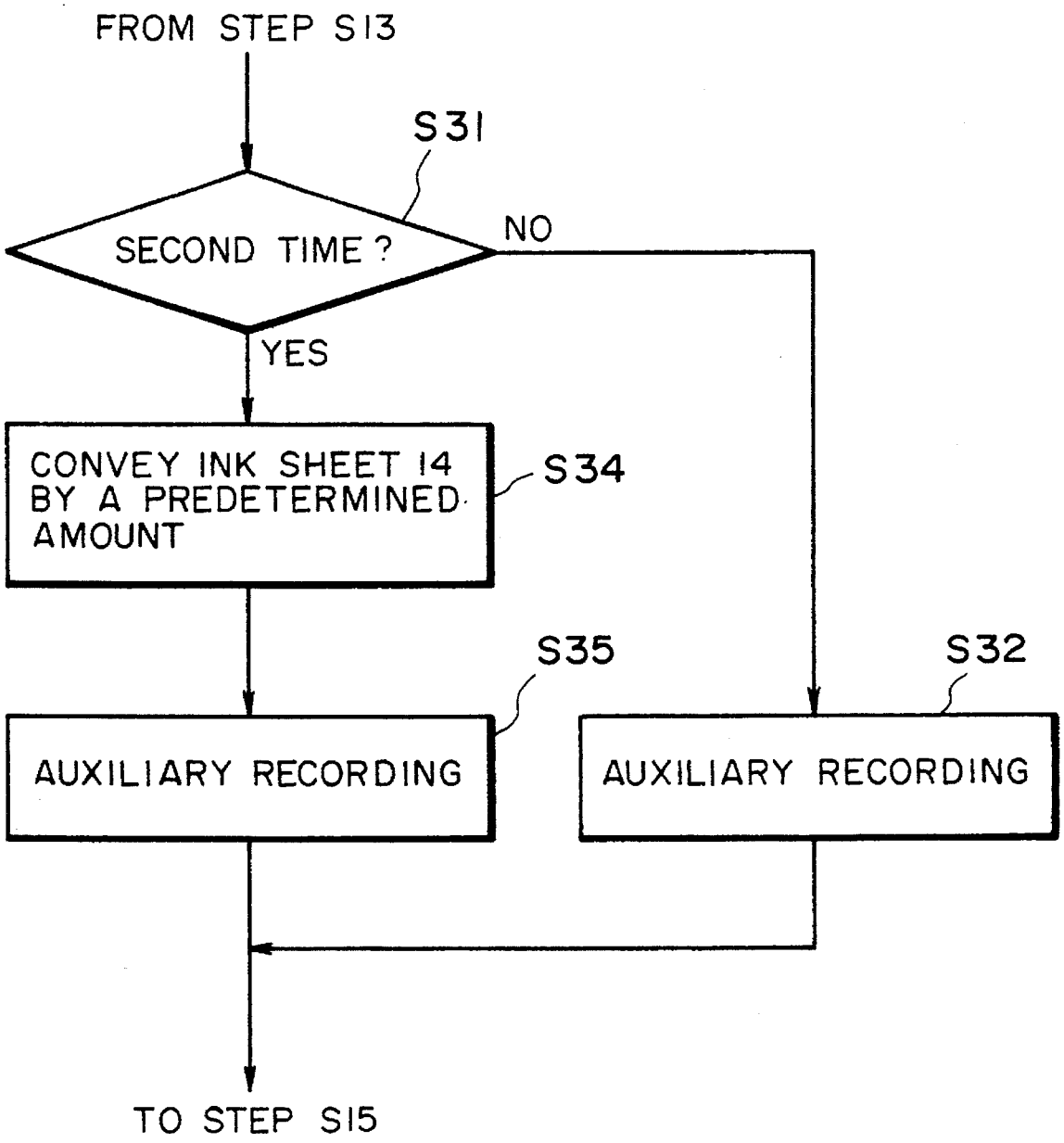
FIG. 5B is a flow chart which shows the process of changing the steps required for conveying an ink sheet in correspondence with the number of times auxiliary recording is performed.

FIG. 5B shows the flow chart of the process of changing the number of steps required for conveying the ink sheet 14 in correspondence with the number of times of the auxiliary recording, this processing flowchart being interposed between Step S13 and Step S15 in FIG. 5A.

In the flowchart shown in FIG. 5B, in succession from Step S13, a decision is made in Step S31 as to whether or not the auxiliary recording is carried out for the second time. In the case of NO, the processing proceeds to Step S32 in which the auxiliary recording for recording the same image data over again is executed. While when it is decided that the auxiliary recording is carried out for the second time, the processing proceeds to Step S34 in which the ink sheet conveying motor 25 is driven for a given step so as to convey the ink sheet 14 for a given length. In Step S35, the auxiliary recording is then performed. The auxiliary recording performed in Steps S33 and S35 may be the same or changed by, for example, changing the energization times. The length for which the ink sheet 14 is conveyed in Step S34 may be the same as or different from the length of conveyance in Step S13 shown in FIG. 5A.

Further, during the auxiliary recording, the power of phase excitation current if the ink sheet conveying motor 25 may be reduced so that the moving speed of the ink sheet 14 is lowered. The number of steps for which the ink sheet 14 is advanced may be changed in correspondence with the number of times of auxiliary recording, for example, the ink sheet conveying motor 25 is driven for 1 step for each 2 scan.

Although, in this embodiment, the recording of an image is described by using a multi-printing ink sheet, the use of a one-time ink sheet enables the same processing. When a multi-ink sheet is used, it is possible to record an image by conveying the ink sheet for a shorter length, for example, a length corresponding to 1/n lines, as compared with the conveyance of the recording paper for one line. In this case, it is also considered that the ink sheet need not be conveyed during the auxiliary recording.

Figure 8:
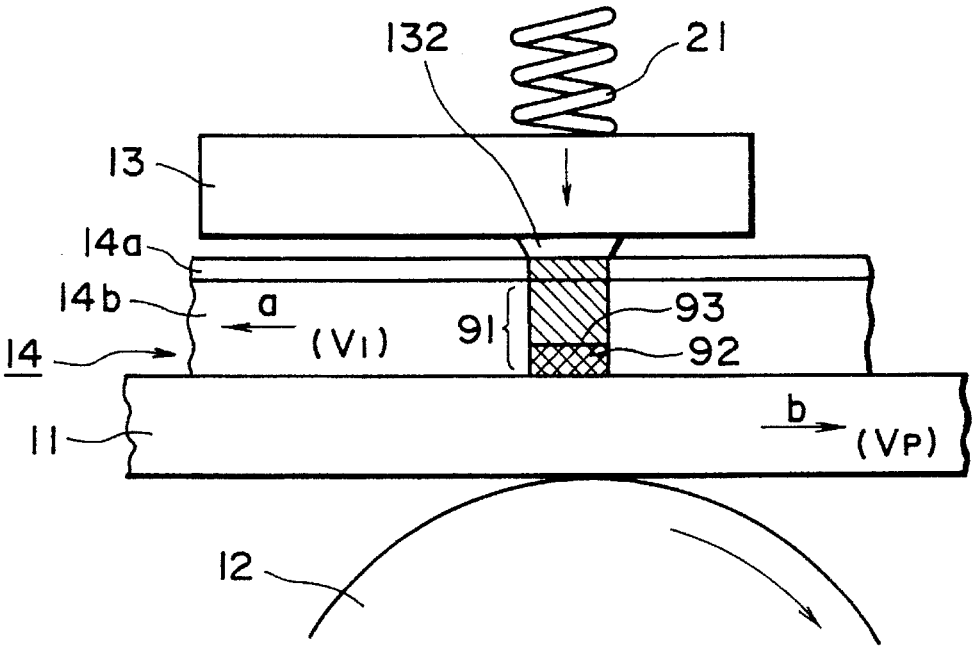
FIG. 8 is a drawing of the structure of the ink sheet and the state of the recording paper and the ink sheet during recording.

Description of Recording Principle (FIG. 8)

FIG. 8 is a drawing of the image recording state in this embodiment in which the recording paper 11 is conveyed in the direction reverse to the direction of conveyance of the ink sheet 14 during the recording of an image.

As shown in the drawing, the recording paper 11 and the ink sheet 14 are held between the platen roller 12 and the thermal head 13 which is pressed against the platen roller 12 at a given pressure by the spring 21. The recording paper 11 is conveyed by the rotation of the platen roller 12 at a speed of Vp in the direction shown by the arrow b. While the ink sheet 14 is conveyed by the rotation of the ink sheet conveying motor 25 a speed of $V_I$ in the direction shown by the arrow a.

When the heating resistor 132 of the thermal head 13 is energized and heated, a shadowed portion 91 of the ink sheet 14 is heated. Reference numeral 14*a* denotes a base film of the ink sheet 14 and reference numeral 14*b* denotes an ink layer of the ink sheet 14.

When the heating resistor 132 is heated by being energized, the ink 91 in the ink layer 14*b* is melted, and a portion denoted by reference numeral 92 is transferred to the recording paper 11. The transferred portion 92 of the ink layer corresponds to 1/n of the ink layer denoted by reference numeral 91.

During the transfer, it is necessary to transfer only the portion 92 of the ink layer to the recording paper 11 by acting shearing force on the ink at a boundary 93 in the ink layer 14*b*. However, since this shearing force depends upon the temperature of the ink layer, there is a tendency that the higher the temperature of the ink layer, the smaller the shearing force. If the time for heating the ink sheet 14 is reduced, therefore, the shearing force in the ink layer is increased. The ink layer to be transferred can thus be certainly separated from the ink sheet 14 by increasing the speed of the ink sheet relative to the recording paper 11.

In this embodiment, since the time for heating the thermal head 13 in the facsimile apparatus is as short as about 0.6 ms, the direction of conveyance of the ink sheet 14 is reversed (opposite) to that of the recording paper 11 so that the speed of the ink sheet 14 relative to the recording paper 11 is increased.

In addition, although, in this embodiment, the direction of conveyance of the recording paper 11 is reversed to that of the ink sheet 14, an embodiment is not limited to this, and the present invention can be applied to a case in which the recording paper 11 and the ink sheet 14 are conveyed in the same direction.

Figure 9:
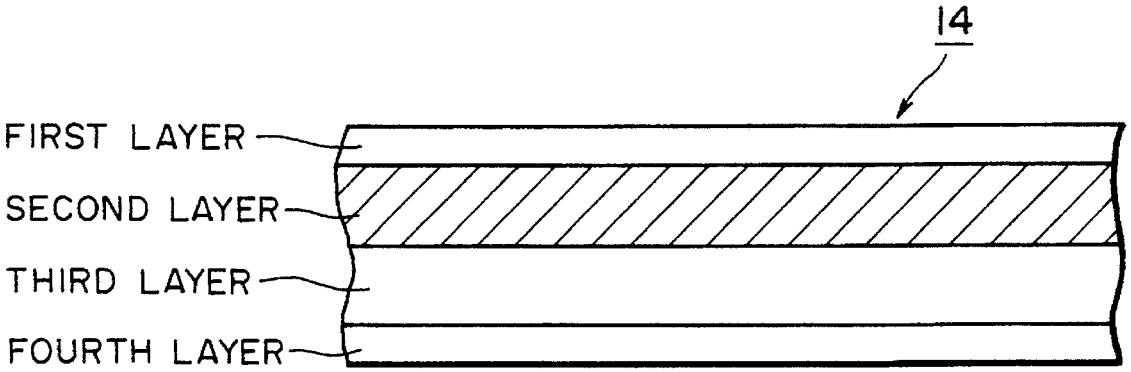
FIG. 9 is a sectional view of the ink sheet used in the embodiment.

Description of Ink Sheet (FIG. 9)

FIG. 9 is a sectional view of the multi-ink sheet used in multi-printing in this embodiment, the sheet comprising four layers.

In the drawing, a second layer is a base film serving as a supporting material for the ink sheet 14. In a case of multi-printing, since thermal energy is applied several times to the same position, although aromatic polyamide films with a high level of heat resistance and capacitor paper are useful, conventional polyester films can also be used. Since each of such films serves as a recording medium, it is advantageous that the thickness of each of the films is as small as possible from the viewpoint of the quality of printing and is 3 to 8 mm from the viewpoint of strength.

A third layer is an ink layer containing ink in an amount which can be transferred n times to the recording paper (recording sheet). The third layer is mainly composed of a resin such as EVA serving as an adhesive, carbon black or a nigrosine dye used for coloring, carnauba wax or paraffin wax serving as a binding material, which are all mixed so as to be tolerable for n times of use. Although the amount of the third layer coated is preferably 4 to 8 g/m$^2$, the amount affects the sensitivity and the density of the image recorded and can be arbitrarily selected.

A fourth layer is a portion on which no printing is performed and is a top coating layer composed of wax for preventing the ink in the third layer from being pressure-transferred to the recording paper. Only the transparent fourth layer is thus pressure-transferred so that greasing of the recording paper can be prevented. A first layer is a heat resistant coated layer for protecting the base film of the second layer from the heat generated from the thermal head 13. Although this layer is suitable for multi-printing having the possibility of application of thermal energy for n lines to the same position (then black information is continued), the use of the first layer can be appropriately selected. The first layer is also effective to a base film such as a polyester film having a relatively low level of heat resistance.

The structure of the ink sheet 14 is not limited to this embodiment, for example, the ink sheet 14 may comprise a base layer and a porous ink holding layer which is provided on said of the base layer and which contains an ink or a heat resistant ink layer with a finely porous net structure which is provided on the base film and which contains an ink. Examples of materials for the base film include films and papers made of polyamides, polyethylene, polyesters, polyvinyl chloride, triacetyl cellulose, nylon and the like. The heat resistant coated layer is not always necessary and may be made of, for example, silicone resin, epoxy resin, fluorine resin, nitrocellulose or the like.

An example of the ink sheet having a heat-subliming ink comprises a base made of a polyethylene terephthalate, polyethylene naphthalate or aromatic polyamide film and a coloring material layer which is provided on the base and which contains a dye and spacer granules made of guanamine resin and fluorine resin.

The heating method in a heat-transfer printer is not limited to the above-described thermal head method using the thermal head, for example, an energization method, a laser transfer method or the like may be used.

Although this embodiment is described above using the thermal line head for recording an image, the embodiment is not limited to this and may use a so-called serial type of heat transfer printer.

In addition, although the embodiment is described above using a case in which a heat transfer printer is applied to facsimile apparatus, the embodiment is not limited to this, for example, the heat-transfer recorder can be applied to a word processor, a type writer or a copying apparatus.

The recording medium is not limited to the recording paper, and any materials such as cloth, plastic sheets and the like, which allow ink to be transferred, can be used as a recording medium. Further, the ink sheet is not limited to the roll structure shown in the embodiment, for example, an ink sheet cassette type may be employed in which the ink sheet may be contained in a casing which is detachably mounted in the recorder body.

As described above, this embodiment is capable of preventing the occurrence of a white line in the image recorded by performing auxiliary recording in a heat-transfer printer and thus enables a satisfactory image density to be obtained.

In addition, in the embodiment, since the recording paper and the ink sheet always have a relative speed, the shearing force acting on the ink layer in the ink sheet is increased, resulting in an effect of improving the quality of the image recorded.

Further, the auxiliary recording in the embodiment is effective in a recorder such as facsimile which has the possibility of occurrence of non-uniformity and an increase in the interval of the image data of each line.

As described above, the present invention has an effect of preventing the occurrence of a white line on a recording medium by recording image data over again while moving the ink sheet with the recording medium being stopped after recording has been completed.

What is claimed is:

1. A thermal transfer recording apparatus for transferring ink of an ink sheet onto a recording medium by utilizing thermal energy generated by a thermal head to record an image on the recording medium based on image data, said apparatus comprising:

a recording medium conveying mechanism for conveying the recording medium, said recording medium conveying mechanism having a driving section for generating a driving force for conveying the recording medium;

an ink sheet conveying mechanism for conveying the ink sheet; and a control section for controlling image recording by the thermal head, conveyance of the recording medium by said recording medium conveying mechanism and conveyance of the ink sheet by said ink sheet conveying mechanism, wherein after the image recording by the thermal head and between generation of the driving force by said driving section and next generation of the driving force, said control section controls said ink sheet conveying mechanism to convey the ink sheet to record an image of image data identical to that used in the image recording.

2. An apparatus according to claim 1, wherein the recording medium is moved by moment of inertia and then stopped between the generation of the driving force by said driving section and the next generation of the driving force.

3. An apparatus according to claim 1, wherein an execution number of image recordings using the identical image data is settable.

4. An apparatus according to claim 1, wherein a conveying length of the ink sheet when the image recording using the identical image data is performed is changeable to be shorter than a conveying length of the ink sheet in the image recording during the generation of the driving force by said driving section.

5. An apparatus according to claim 1, wherein a time period of heat generation by the thermal head when the image recording using the identical image data is performed is shorter than that of the heat generation by the thermal head in the image recording during the generation of the driving force by said driving section.

6. An apparatus according to claim 1, wherein the ink sheet and the recording medium are conveyed in directions opposite to each other when the thermal head performs the image recording.

7. An apparatus according to claim 1, wherein a conveying length of the ink sheet is shorter than that of the recording medium when the thermal head performs the image recording.

8. An apparatus according to claim 1, further comprising means for receiving an image signal from an external source to supply the image data for recording on the recording medium.

9. A thermal transfer recording apparatus according to claim 1, wherein the ink sheet contains an ink layer capable of recording plural times in a thickness direction of the ink sheet.

10. A thermal transfer recording method for transferring ink of an ink sheet onto a recording medium by utilizing thermal energy generated by a thermal head to record an image on the recording medium based on image data, said method comprising the steps of:

conveying the recording medium with a recording medium conveying mechanism having a driving section for generating a driving force for conveying the recording medium;

conveying the ink sheet with an ink sheet conveying mechanism; and controlling image recording by the thermal head, conveyance of the recording medium by the recording medium conveying mechanism and conveyance of the ink sheet by the ink sheet conveying mechanism, wherein after the image recording by the thermal head and between generation of the driving force by the driving section and next generation of the driving force, the ink sheet conveying mechanism is controlled to convey the ink sheet to record an image of image data identical to that used in the image recording.

11. A method according to claim 10, wherein the recording medium is moved by moment of inertia and then stopped between the generation of the driving force by the driving section and the next generation of the driving force.

12. A method according to claim 10, further comprising the step of setting an execution number of image recordings using the identical image data.

13. A method according to claim 10 further comprising the step of changing a conveying length of the ink sheet when the image recording by using the identical image data is performed to be shorter than a conveying length of the ink sheet in the image recording during the generation of the driving force by the driving section.

14. A method according to claim 10, wherein a time period of heat generation by the thermal head when the image recording by the identical image data is performed is shorter than that of the heat generation by the thermal head in the image recording during the generation of the driving force by the driving section.

15. A method according to claim 10, wherein the ink sheet and the recording medium are conveyed in directions opposite to each other when the thermal head performs the image recording.

16. A method according to claim 10, wherein a conveying length of the ink sheet is shorter than that of the recording medium when the thermal head performs the image recording.

17. A method according to claim 10, further comprising the step of receiving an image signal from an external source to supply the image data for recording on the recording medium.

18. A thermal transfer recording method according to claim 10, wherein the ink sheet contains an ink layer capable of recording plural times in a thickness direction of the ink sheet.

19. A thermal transfer recording apparatus for transferring ink of an ink sheet onto a recording sheet by utilizing thermal energy generated by a thermal head to record an image on the recording sheet based on image data, said apparatus comprising:

a recording sheet conveying mechanism for conveying the recording sheet, said recording sheet conveying mechanism having a driving section for generating a driving force for conveying the recording sheet;

an ink sheet conveying mechanism for conveying the ink sheet; and a control section for controlling image recording by the thermal head, conveyance of the recording sheet by said recording sheet conveying mechanism and conveyance of the ink sheet by said ink sheet conveying mechanism, wherein after the image recording by the thermal head and between generation of the driving force by said driving section and next generation of the driving force, said control section controls said thermal head to record on the recording sheet image data identical to image data used immediately before, and a conveying length of the ink sheet when the image recording using the identical image data is performed is changeable to be shorter than a conveying length of the ink sheet in the image recording during the generation of the driving force by said driving section.

20. An apparatus according to claim 19, wherein the recording sheet is moved by moment of inertia and then stopped between the generation of the driving force by said driving section and the next generation of the driving force.

21. An apparatus according to claim 19, wherein an execution number of image recordings using the identical image data is settable.

22. An apparatus according to claim 19, wherein a time period of heat generation by the thermal head when the image recording using the identical image data is performed is shorter than that of the heat generation by the thermal head in the image recording during the generation of the driving force by said driving section.

23. An apparatus according to claim 19, wherein the ink sheet and the recording sheet are conveyed in directions opposite to each other when the thermal head performs the image recording.

24. An apparatus according to claim 19, wherein a conveying length of the ink sheet is shorter than that of the recording sheet when the thermal head performs the image recording during the generation of the driving force by said driving section.

25. An apparatus according to claim 19, further comprising means for receiving an image signal from an external source to supply the image data for recording on the recording sheet.

26. A thermal transfer recording apparatus according to claim 19, wherein the ink sheet contains an ink layer capable of recording plural times in a thickness direction of the ink sheet.

27. A thermal transfer recording method for transferring ink of an ink sheet onto a recording sheet by utilizing thermal energy generated by a thermal head to record an image on the recording sheet based on image data, said method comprising the steps of:

conveying the recording sheet with a recording sheet conveying mechanism having a driving section for generating a driving force for conveying the recording sheet;

conveying the ink sheet with an ink sheet conveying mechanism;

controlling image recording by the thermal head, conveyance of the recording sheet by the recording sheet conveying mechanism and conveyance of the ink sheet by the ink sheet conveying mechanism, so that after the image recording by the thermal head and between generation of the driving force by the driving section and next generation of the driving force, said thermal head is controlled to record on the recording sheet image data identical to image data used immediately before; and changing a conveying length of the ink sheet when the image recording by using the identical image data is performed to be shorter than a conveying length of the ink sheet in the image recording during the generation of the driving force by the driving section.

28. A method according to claim 27, wherein the recording sheet is moved by moment of inertia and then stopped between the generation of the driving force by the driving section and the next generation of the driving force.

29. A method according to claim 27, further comprising the step of setting an execution number of image recordings using the identical image data.

30. A method according to claim 27, wherein a time period of heat generation by the thermal head when the image recording by the identical image data is performed is shorter than that of the heat generation by the thermal head in the image recording during the generation of the driving force by the driving section.

31. A method according to claim 27, wherein the ink sheet and the recording sheet are conveyed in directions opposite to each other when the thermal head performs the image recording.

32. A method according to claim 27, wherein a conveying length of the ink sheet is shorter than that of the recording sheet when the thermal head performs the image recording during the generation of the driving force by the driving section.

33. A method according to claim 27, further comprising the step of receiving an image signal from an external source to supply the image data for recording on the recording sheet.

34. A thermal transfer recording method according to claims 27, wherein the ink sheet contains an ink layer capable of recording plural times in a thickness direction of the ink sheet.

35. A thermal transfer recording apparatus for recording an image in accordance with image data on a recording sheet by transferring ink of an ink sheet, said apparatus comprising:

a recording sheet conveying mechanism for conveying the recording sheet, said recording sheet conveying mechanism having a driving section for generating a driving force for conveying the recording sheet;

an ink sheet conveying mechanism for conveying the ink sheet;

a thermal head having heat generating elements arranged correspondingly to a width of the recording sheet in a direction perpendicular to a conveyance direction of the recording sheet; and a control section for controlling image recording by the thermal head, conveyance of the recording sheet by said recording sheet conveying mechanism and conveyance of the ink sheet by said ink sheet conveying mechanism, wherein said control section controls said ink sheet conveying mechanism to convey the ink sheet and controls said thermal head to record the same image data as immediately previously used image data on the recording sheet when the conveyance of the recording sheet for the image recording for one line is not completed between commencement of the conveyance of the recording sheet upon generation of the driving force from said driving section and termination of image recording of the one line by said thermal head.

36. An apparatus according to claim 35, wherein the recording sheet is moved by moment of inertia and then stopped between the generation of the driving force by said driving section and the next generation of the driving force.

37. An apparatus according to claim 35, wherein an execution number of image recordings using the identical image data is settable.

38. An apparatus according to claim 35, wherein a time period of heat generation by the thermal head when the image recording using the identical image data is performed is shorter than that of the heat generation by the thermal head in the image recording during the generation of the driving force by said driving section.

39. An apparatus according to claim 35, wherein the ink sheet and the recording sheet are conveyed in directions opposite to each other when the thermal head performs the image recording.

40. An apparatus according to claim 35, wherein a conveying length of the ink sheet is shorter than that of the recording sheet when the thermal head performs the image recording.

41. An apparatus according to claim 35, further comprising means for receiving an image signal from an external source to supply the image data for recording on the recording sheet.

42. A thermal transfer recording apparatus according to claim 35, wherein the ink sheet contains an ink layer capable of recording plural times in a thickness direction of the ink sheet.

43. A thermal transfer recording apparatus for recording an image in accordance with image data on a recording sheet by transferring ink of an ink sheet said apparatus comprising:

a recording sheet conveying mechanism for conveying the recording sheet, said recording sheet conveying mechanism having a driving section for generating a driving force for conveying the recording sheet;

an ink sheet conveying mechanism for conveying the ink sheet;

a thermal head having heat generating elements arranged correspondingly to a width of the recording sheet in a direction perpendicular to a conveyance direction of the recording sheet; and a control section for controlling image recording by the thermal head, conveyance of the recording sheet by said recording sheet conveying mechanism and conveyance of the ink sheet by said ink sheet conveying mechanism, wherein said control section records the same image data as immediately previously used image data on the recording sheet when the conveyance of the recording sheet for the image recording for one line is not completed between commencement of the conveyance of the recording sheet upon generation of the driving force from said driving section and termination of image recording of the one line by said thermal head, and a conveying length of the ink sheet when the image recording using the same image data is performed is changeable to be shorter than a conveying length of the ink sheet in the image recording during the generation of the driving force by said driving section.

44. An apparatus according to claim 43, wherein the recording sheet is moved by moment of inertia and then stopped between the generation of the driving force by said driving section and the next generation of the driving force.

45. An apparatus according to claim 43, wherein an execution number of image recordings using the identical image data is settable.

46. An apparatus according to claim 43, wherein a time period of heat generation by the thermal head when the image recording using the identical image data is performed is shorter than that of the heat generation by the thermal head in the image recording during the generation of the driving force by said driving section.

47. An apparatus according to claim 43, wherein the ink sheet and the recording sheet are conveyed in directions opposite to each other when the thermal head performs the image recording.

48. An apparatus according to claim 43, wherein a conveying length of the ink sheet is shorter than that of the recording sheet when the thermal head performs the image recording.

49. An apparatus according to claim 43, further comprising means for receiving an image signal from an external source to supply the image data for recording on the recording sheet.

50. A thermal transfer recording apparatus according to claim 43, wherein the ink sheet contains an ink layer capable of recording plural times in a thickness direction of the ink sheet.

* * * * *

UNITED STATES PATENT AND TRADEMARK OFFICE

CERTIFICATE OF CORRECTION

PATENT NO. : 5,587,733

DATED : December 24, 1996

INVENTORS : TAKESHI ONO ET AL.

It is certified that error appears in the above-identified patent and that said Letters Patent is hereby corrected as shown below:

COLUMN 1

Line 18, "apparatus," should read --apparatuses--;
Line 67, "energezation" should read --energization--.

COLUMN 3

Line 23, "recording, paper" should read --recording paper--.

COLUMN 4

Line 53, "and, a" should read --and a--.

UNITED STATES PATENT AND TRADEMARK OFFICE

CERTIFICATE OF CORRECTION

PATENT NO. : 5,587,733

DATED : December 24, 1996

INVENTORS : TAKESHI ONO ET AL.

It is certified that error appears in the above-identified patent and that said Letters Patent is hereby corrected as shown below:

COLUMN 6

Line 1, "basis" should read --basis of--;
Line 3, "other which" should read --other; cutters 15--;
Line 39, "mode enable" should read --enabled--.

COLUMN 12

Line 18, "10" should read --10,--.

Signed and Sealed this

Twelfth Day of August, 1997

Bruce Lehman

*Attest:*

BRUCE LEHMAN

*Attesting Officer*

*Commissioner of Patents and Trademarks*